United States Patent [19]

Kalkbrenner et al.

[11] Patent Number: 4,601,221

[45] Date of Patent: Jul. 22, 1986

[54] CLAMPING DEVICE FOR RECTANGULAR WORKPIECE

[75] Inventors: Ralph W. Kalkbrenner, Irwin; Hans E. Leumann, Washington, both of Pa.

[73] Assignee: Westinghouse Electric Corp., Pittsburgh, Pa.

[21] Appl. No.: 670,419

[22] Filed: Nov. 9, 1984

[51] Int. Cl.[4] ..... B25B 7/02

[52] U.S. Cl. ..... 81/418; 269/272; 269/258

[58] Field of Search ..... 81/418, 421, 422, 423, 81/424; 269/272, 258

[56] References Cited

U.S. PATENT DOCUMENTS

| | | | |
|---|---|---|---|
| 743,593 | 11/1903 | Thumann et al. | 81/424 |
| 985,086 | 2/1911 | Wilkes . | |
| 1,321,208 | 11/1919 | Hinnershitz | 81/424 |
| 1,334,965 | 3/1920 | Ridings | 81/423 |
| 1,353,719 | 9/1920 | Baresch . | |
| 3,133,461 | 5/1964 | Walton | 81/418 |
| 3,931,671 | 1/1976 | Dittmann . | |
| 4,174,847 | 11/1979 | Wiesler | 279/1 L |
| 4,373,373 | 2/1983 | Schaefer | 81/421 |
| 4,378,937 | 4/1983 | Dearman | 269/258 |

*Primary Examiner*—James L. Jones, Jr.
*Attorney, Agent, or Firm*—L. P. Johns

[57] ABSTRACT

A clamping device for rectangular configurations characterized by two opposed jaws each having right-angled jaw portions and each pivotally mounted on separate support means for movement to and from each other so that the jaws form rectangular openings with self-adjusting aspect ratio for holding a rectangular workpiece.

7 Claims, 11 Drawing Figures

CLAMPING DEVICE FOR RECTANGULAR WORKPIECE

BACKGROUND OF THE INVENTION

1. Field of the Invention

This invention relates to a clamping device for holding and retaining rectangular configurations and more particularly, an infinite variety of square or rectangular objects within its dimensional range over their entire perimeter.

2. Description of the Prior Art

The conventional type of "universal" vise, gripper, clamp, or jaws usually have a V block configuration and tend to grip or clamp a workpiece at points or restricted areas common to the particular shape. There are, however, instances where these shapes or configurations are difficult or impossible to grip or clamp with existing clamps, regardless of how universal they are alleged to be. The aspect ratio, for instance length to width, of some configurations, or the very shape of the objects, cause the objects to slip out of the clamping device when pressure is applied. Moreover, composite configurations, such as workpieces with a cross-section consisting of various components, are particularly difficult to clamp, since the components are free to shift with respect to one another. Either the entire section, or one or more of the components tend to escape the desired clamping action.

SUMMARY OF THE INVENTION

In accordance with this invention a passively adjusting clamping tool for holding and retaining a workpiece of rectangular configuration is provided which comprises two opposed jaws each having right angled jaw portions and each pivotally mounted for movement to and from each other so that the jaws form rectangular openings for holding a rectangular workpiece, and support means separately supporting the jaws for movement to and from each other.

The advantage of the device of this invention is that it eliminates problems inherent in prior known clamping mechanisms for holding an infinite variety of square and rectangular cross-sections, regardless of aspect ratio, by automatically contacting and gripping the entire perimeter of the workpiece, thereby applying clamping pressure uniformly on all components of the cross-section.

DESCRIPTION OF THE PREFERRED EMBODIMENTS

Figure 1:
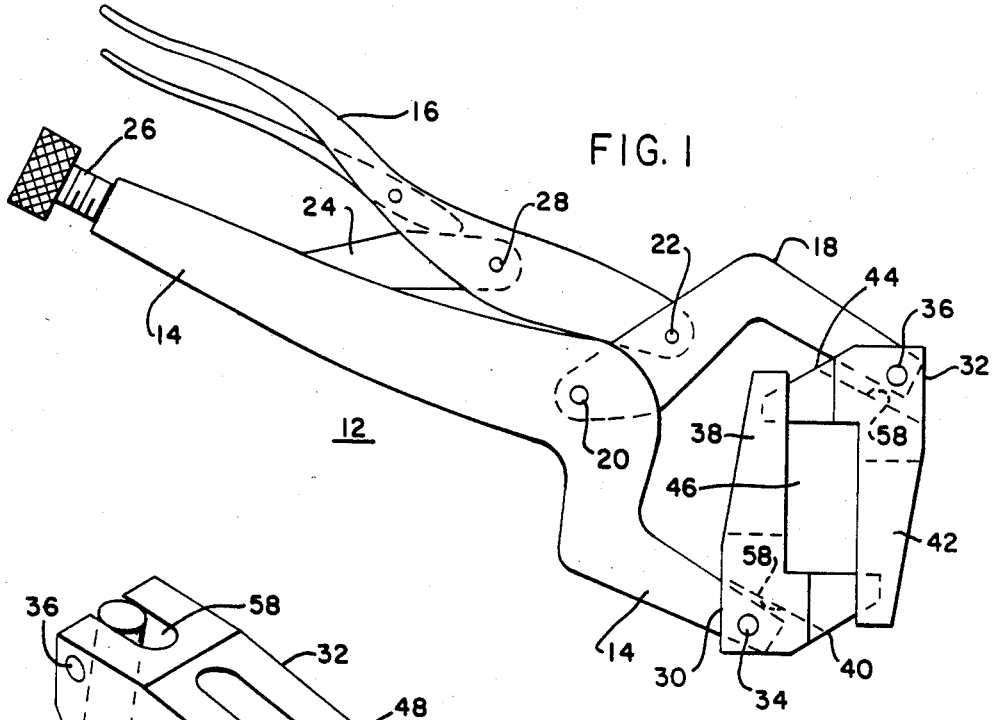
FIG. 1 is a plan view of a clamping device in accordance with this invention.

A clamping device or tongs are generally indicated at 12 in FIG. 1. The particular embodiment of the device shown is a VISE GRIP of conventional construction, but is not limited to the vise grip concept and may be of a more conventional type of tongs or pliers. The device 12 comprises a pair of handles 14, 16. An extension handle 18 is pivotally mounted at 20 on the handle 14 and is actuated by the handle 16 which is pivoted at 22 and link 24 which is movable longitudinally by a set screw 26 locates a pivot 28 for adjusting closure spacing between a pair of jaws 30, 32.

In accordance with this invention jaws 30, 32 are pivotally mounted at 34, 36, respectively, on the handles 14, 18. The jaws 30, 32 are L-shaped members with the jaw 32 including a long leg 38 and short leg 40. Similarly, the jaw 32 includes a long leg 42 and a short leg 44. The short and long legs of each jaw are disposed at right angles to each other so that when brought together they form a rectangular opening 46 (FIG. 1).

Figure 2:
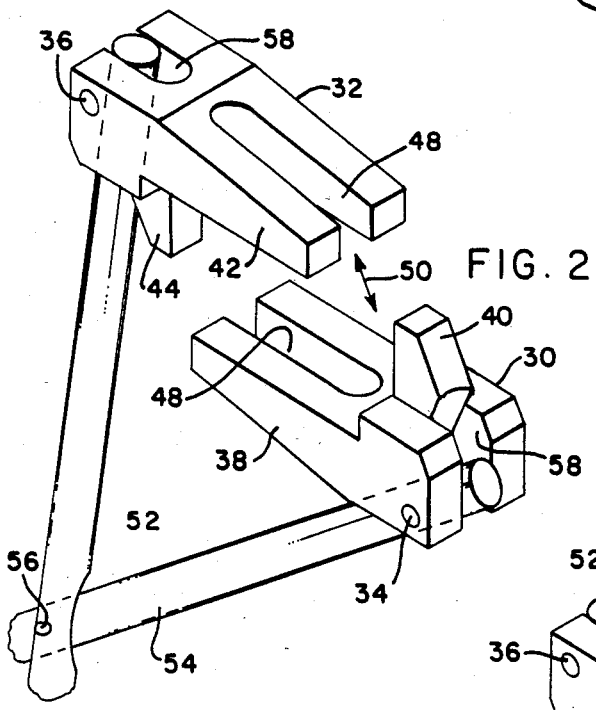
FIGS. 2 and 3 are isometric views of clamping devices having handles of an embodiment different from those of FIG. 1 and showing clamping jaws in different positions.

As shown more particularly in FIG. 2, one of the long and short leg of each jaw 30, 32, such as the long legs 38, 42, include similar slots 48. The other of the short and long legs, such as the short legs 40, 44, fit into and slide along corresponding slots 48 of the opposed jaws 30, 32. Accordingly, when the jaws are brought together as indicated by arrows 50 (FIG. 2), the short legs 40, 42 enter corresponding slots 48 of the opposed jaws 30, 32.

Figure 3:
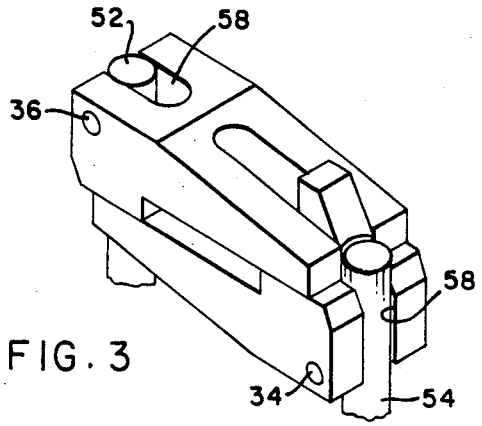
Figure 4:
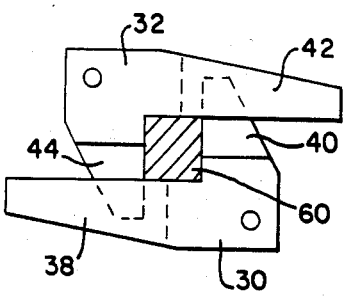
FIGS. 4 through 9 are elevational views showing the clamp jaws in various positions for workpieces of different configurations.
Figure 5:
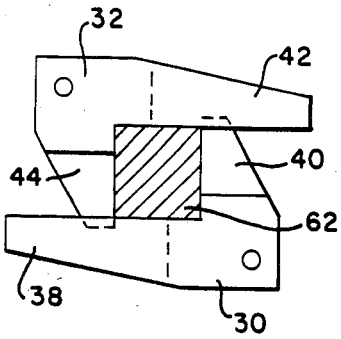
Figure 6:
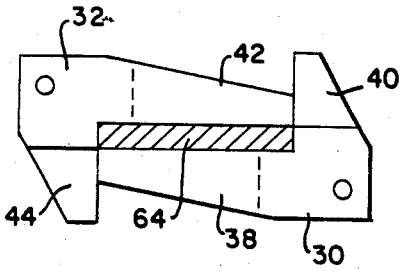
Figure 7:
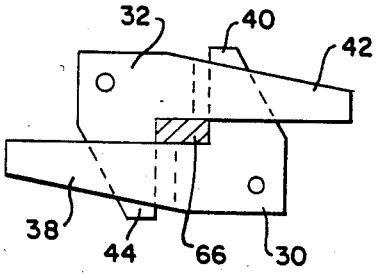
Figure 8:
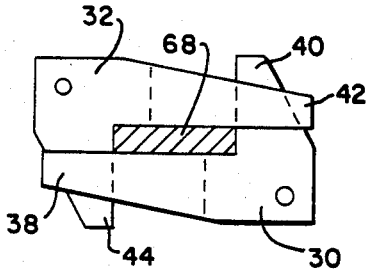
Figure 9:
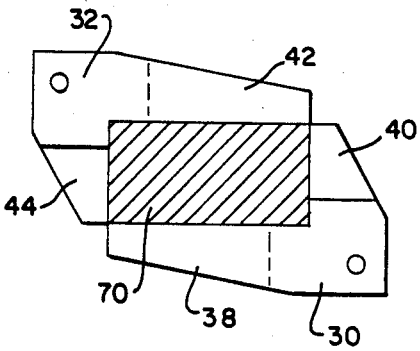
Figure 10:
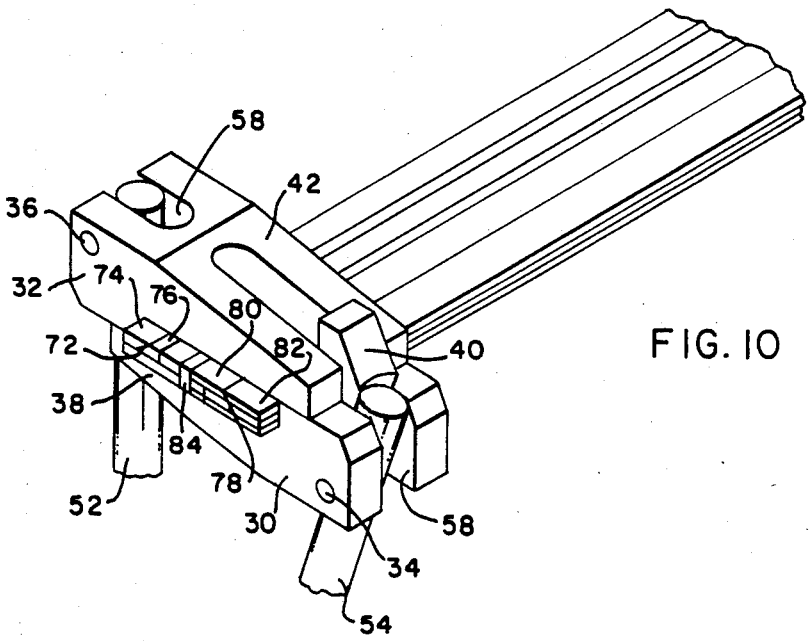
FIG. 10 is a perspective view of the clamping device holding a composite assembly of workpieces having different configurations.

As shown in FIGS. 2, 3, 10 the jaws 30, 32 may be mounted on elongated rod-like handles or tongs 52, 54 which like the handles 14, 18 are pivotally secured by pivot pins 34, 36. The handles 52, 54 are pivoted at 56 in a conventional manner.

The jaws 30, 32 are provided with similar notches 58 in which handles or tongs 52, 54 extend and where they are pivotally mounted. Similarly, handles 52, 54 (FIG. 2) extend into notches 58 where they are pivotally mounted by pins 34, 36. In this manner the jaws 30, 32 are free to rotate within limited arcs to accommodate the size and/or configuration of the particular workpiece to be gripped by the tongs in the opening 46.

The particular structure of the jaws 30, 32 enables the handling of workpieces having varying rectangular cross-sections and dimensions. For purposes of illustration, the several workpieces 60, 62, 64, 66, 68, 70 (FIGS. 4–9) are shown in cross-section. Workpieces 60, 62 have square cross-sections, the latter being of greater dimension than the former, which are enclosed around their entire perimeter by the legs of the jaws. Similarly, the workpieces 64, 62, 68, 70 are rectangular (non-square) members whose dimensions of width and thickness vary substantially. Nevertheless, the jaws 30, 32 encompass the entire perimeter of each member 64–70 and adjust themselves passively to the required aspect ratio.

Figure 11:
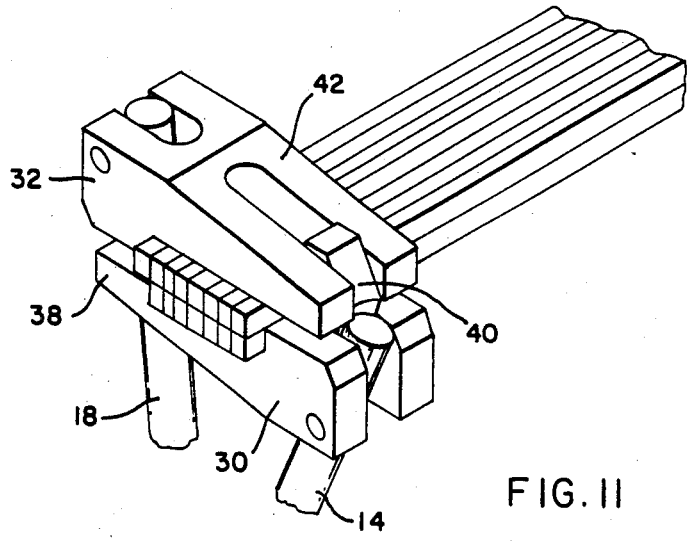
FIG. 11 is a perspective view of a clamping device holding a plurality of workpieces of uniform cross-section.

FIGS. 10 and 11 show the manner in which the jaws 30, 32 handle a workpiece having a plurality of parts. In FIG. 10 a composite workpiece is shown in which the several parts of the unified workpiece have different dimensions and/or configurations. For example, an inclined edge 72 exists between adjacent members 74, 76 and an inclined edge 78 similarly exists between members 80, 82. In addition, a member 84 having a larger vertical side dimension is disposed between adjacent members having larger horizontal dimensions.

Suffice it to say, the composite workpiece is held and retained between the jaws 30, 32.

In FIG. 11 the jaws 30, 32 accommodate a workpiece of multiple components in which the number of components in a lower row is less than those in the upper row.

In summary, if the cross-section is built up of loose or free-to-slide components, each of these components share the clamping force, thereby confining and retaining them into the required shape of the workpiece without requiring any external or preliminary aspect ratio adjustment or set up of the clamping jaws.

Accordingly, the clamping device or tongs of this invention automatically orient themselves to contact and grip a workpiece along its entire perimeter. This capability makes the device suitable for non-marring clamps, for accurate location and clamping applications, and particularly for very difficult tasks of gripping and clamping composite sections where the individual components must be oriented and located and retained. By gripping the entire perimeter of any of the configurations, the device obviously grips all of the components.

Finally, the jaws of this clamping device are automatically oriented entirely passively. There is no preliminary or external setting, set up, predisposition or adjustment required to obtain the clamping action of an infinite variety of shapes within the dimensional range of the device.

What is claimed is:

1. A clamping device for holding a workpiece of rectangular configuration along its entire perimeter, comprising:

(a) two opposed L-shaped jaws with each jaw pivotally mounted and including a pair of jaw portions extending perpendicular to each other forming rectangular openings between oppositely-facing jaws so as to automatically orient to the rectangular shape of a workpiece; and (b) support means separately supporting the jaws pivotally for movement to and from each other.

2. The clamping device of claim 1 in which the support means comprise a pair of tongs pivotally connected.

3. The clamping device of claim 2 in which one portion of each pair of jaw portions is shorter than the other.

4. The clamping device of claim 3 in which the longer portions of the jaws are parallel when gripping a workpiece.

5. The clamping device of claim 4 in which one of the jaw portions is slotted to comprise spaced longitudinal prongs of each jaw portion and the other jaw portion is removable between the prongs as the tongs grip a workpiece.

6. The clamping device of claim 5 in which the longer jaw portions comprise the slot.

7. The clamping device of claim 6 in which each jaw comprises a notch in which the corresponding tong is disposed.

* * * * *